US010753594B2

(12) United States Patent
Jiang

(10) Patent No.: US 10,753,594 B2
(45) Date of Patent: Aug. 25, 2020

(54) WATERPROOF STAGE LIGHT WITH EFFICIENT HEAT DISSIPATION

(71) Applicant: Guangzhou Haoyang Electronic Co., Ltd., Guangzhou, Guangdong (CN)

(72) Inventor: Weikai Jiang, Guangzhou (CN)

(73) Assignee: Guangzhou Haoyang Electronic Co., Ltd. (CN)

( * ) Notice: Subject to any disclaimer, the term of this patent is extended or adjusted under 35 U.S.C. 154(b) by 0 days.

(21) Appl. No.: 16/238,999

(22) Filed: Jan. 3, 2019

(65) Prior Publication Data

US 2019/0137090 A1 May 9, 2019

Related U.S. Application Data

(63) Continuation of application No. PCT/CN2017/077200, filed on Mar. 19, 2017.

(30) Foreign Application Priority Data

Jul. 4, 2016 (CN) ..... 2016 1 0515553

(51) Int. Cl.
*F21V 31/00* (2006.01)
*F21V 15/01* (2006.01)
(Continued)

(52) U.S. Cl.
CPC ..... *F21V 31/005* (2013.01); *F21S 8/00* (2013.01); *F21V 15/01* (2013.01); *F21V 17/10* (2013.01);
(Continued)

(58) Field of Classification Search
CPC .. F21S 8/00; F21V 15/01; F21V 17/10; F21V 29/503; F21V 29/67; F21V 29/717;
(Continued)

(56) References Cited

U.S. PATENT DOCUMENTS 6,283,600 B1 * 9/2001 Levasseur ..... F21V 17/02 353/119
6,545,416 B1 * 4/2003 Fisher ..... F21V 23/02 315/56
(Continued)

FOREIGN PATENT DOCUMENTS

CN 201803246 U 4/2011
CN 201866693 U 6/2011
(Continued)

OTHER PUBLICATIONS

International Search Report PCT/CN2017/077200 dated Jun. 21, 2017.

*Primary Examiner* — Tsion Tumebo
(74) *Attorney, Agent, or Firm* — Lerner, David, Littenberg, Krumholz & Mentlik, LLP

(57) ABSTRACT

The present invention discloses a waterproof stage light with efficient heat dissipation comprising a light source component, a heat dissipating system and a waterproof main housing, wherein an opening is arranged at the rear end of the main housing, the heat dissipating system is in seal connection with the opening; one end of the heat dissipating system is positioned inside the main housing and the other end is positioned outside the main housing; and the light source component is arranged on the end of the heat dissipating system that is positioned inside the main housing. The stage light according to the present invention, which is simple in structure and convenient in use, improves the
(Continued)

operation effect, normal service life, and reliability and stability of the stage light, and has a waterproof function, the stage light thus can be normally used outdoors with expanding application.

10 Claims, 4 Drawing Sheets

(51) Int. Cl.

| | |
|---|---|
| ***F21S 8/00*** | (2006.01) |
| ***F21V 29/71*** | (2015.01) |
| ***F21V 29/76*** | (2015.01) |
| ***F21V 29/83*** | (2015.01) |
| ***F21V 29/503*** | (2015.01) |
| ***F21V 29/67*** | (2015.01) |
| ***F21V 17/10*** | (2006.01) |
| ***F21W 131/406*** | (2006.01) |

(52) U.S. Cl.
CPC ..... *F21V 29/503* (2015.01); *F21V 29/67* (2015.01); *F21V 29/717* (2015.01); *F21V 29/76* (2015.01); *F21V 29/763* (2015.01); *F21V 29/83* (2015.01); *F21V 31/00* (2013.01); *F21W 2131/406* (2013.01)

(58) Field of Classification Search
CPC ..... F21V 29/76; F21V 29/763; F21V 29/83; F21V 31/00; F21V 31/005; F21W 2131/406
See application file for complete search history.

(56) References Cited

U.S. PATENT DOCUMENTS

| | | | | |
|---|---|---|---|---|
| D618,377 | S * | 6/2010 | Toft | D26/63 |
| 7,789,525 | B2 * | 9/2010 | Vinther | F21V 21/30 353/72 |
| 9,777,917 | B2 * | 10/2017 | Johansen | F21V 31/03 |
| 10,197,234 | B2 * | 2/2019 | Lentine | F21V 29/70 |
| 2008/0062692 | A1 * | 3/2008 | Andersen | F21S 10/007 362/275 |
| 2008/0089066 | A1 * | 4/2008 | Rasmussen | F21V 19/02 362/264 |
| 2008/0116475 | A1 * | 5/2008 | Chen | F21V 17/12 257/99 |
| 2009/0027890 | A1 * | 1/2009 | Melzner | F21V 29/004 362/294 |
| 2010/0044589 | A1 * | 2/2010 | Garcia | G01N 21/6447 250/492.1 |
| 2014/0119019 | A1 * | 5/2014 | Hsu | F21S 10/007 362/269 |
| 2015/0103553 | A1 * | 4/2015 | Jurik | G02B 6/0096 362/551 |

FOREIGN PATENT DOCUMENTS

| | | | |
|---|---|---|---|
| CN | 105716046 | A | 6/2016 |
| CN | 105953145 | A | 9/2016 |
| CN | 205824763 | U | 12/2016 |
| DE | 202009002127 | U1 | 6/2009 |
| JP | 2011054372 | A | 3/2011 |

* cited by examiner

WATERPROOF STAGE LIGHT WITH EFFICIENT HEAT DISSIPATION

CROSS REFERENCE TO RELATED APPLICATIONS

The present application is a continuation of International Application No. PCT/CN2017/077200, filed Mar. 19, 2017, which claims priority from Chinese Patent Application No. 201610515553.X filed Jul. 4, 2016, all of which are hereby incorporated herein by reference.

TECHNICAL FIELD

The present invention relates to the technical field of stage light, and more particularly to a waterproof stage light with efficient heat dissipation.

BACKGROUND OF THE INVENTION

In the field of stage lighting, the stage light that is used typically has high power, particularly at the light source thereof, such as gas discharge light source or Perkin light source. This type of light source can convert quite a small amount of electric energy into visible light in the operating process, due to limitation of technical properties thereof. And most of the remaining electric energy may be converted into heat, infrared rays, ultraviolet rays, etc. to consume away, so that a large amount of heat will be often generated during operation, and the heat may transfer to the light source, resulting in excessive temperature of the position of light source, such as the bulb, thereby influencing the using effect and service life of the lights, and even leading to serious consequences, such as bulb explosion or bulb whitening. Therefore, there is a need to cool the light source of the stage light.

In the prior art, in order to achieve better heat dissipation effect, holes are often opened on the housing of the stage light, so that external cold air can be sucked into the interior of the light through a fan and then hot air will be forcibly discharged to the outside of the light by a heat dissipating system. Although such method can solve the problem of heat dissipation, the light with such structure is in poor waterproof performance, even without waterproof performance, due to the configuration of the holes on the housing of the light, causing that such stage light can only be used indoor. In order to solve problem of waterproof, some lights achieve waterproof performance by sacrificing heat dissipation effect at the cost of short service life and poor using effect of the light, since the heat dissipation effect cannot reach desired state. Therefore, the existing stage lights fail to have waterproof and efficient heat-dissipation properties.

SUMMARY OF THE INVENTION

In order to overcome at least one of the above-mentioned drawbacks in the prior art, the present invention provides a waterproof stage light with efficient heat dissipation, which is simple in structure and convenient in use. According to the present invention, operation effect, normal service life, reliability and stability of the stage light can be effectively improved. In addition, the stage light according to the present invention has waterproof property, so that the stage light can be normally used outdoors, thus expanding the application of the light.

In order to solve the above-mentioned technical problems, a waterproof stage light with efficient heat dissipation is provided including a light source component, a heat dissipating system and a main housing which is waterproof, wherein an opening is arranged at a rear end of the main housing, the heat dissipating system is in seal connection with the opening such that the main housing forms an enclosed space; one end of the heat dissipating system is positioned inside the main housing and the other end thereof is positioned outside the main housing; and the light source component is positioned on the end of the heat dissipating system that is positioned inside the main housing. Such an arrangement causes that the heat generated by the light source component can be directly absorbed by the end of the heat dissipating system that is positioned inside the main housing. In addition, the heat dissipating system directly transfers the absorbed heat to the other end through heat exchange, and then discharges the exchanged heat to the outside of the light. Therefore, the heat generated by the light source during operation can be well discharged in time.

Further, the heat dissipating system contains a heat absorbing component, a heat transfer substrate, and a heat dissipating component. The heat transfer substrate covers the opening at the rear end of the main housing and is in seal connection with the main housing. The heat absorbing component and the heat dissipating component are respectively arranged on both sides of the heat transfer substrate. The heat absorbing component is located inside the main housing, and the heat dissipating component is located outside the main housing. Through such configuration, the heat absorbing component can absorb the heat generated by the light source component, and then the absorbed heat can be exchanged to the heat dissipating component by the heat transfer substrate, and the heat dissipating component will dissipate the exchanged heat to the outside of the light.

Further, a first waterproof seal ring is arranged between the heat transfer substrate and the main housing. A first annular groove surrounding the opening is arranged on the rear end surface of the main housing. The heat transfer substrate is fixed with the main housing via a bolt. One side of the first waterproof seal ring is embedded in the first annular groove, and the other side is in close contact with the heat transfer substrate. The arrangement of the first waterproof seal ring can prevent rainwater or the like from entering the inside of the main housing through the junction of the heat transfer substrate and the main housing.

Further, the heat absorbing component is provided with an installation position. The light source component, containing a light source and a reflecting device surrounding the light source, is installed in the installation position. In addition, the heat absorbing component surrounds the reflecting device of the light source component and is attached to the reflecting device of the light source component.

Further, the heat absorbing component contains a plurality of heat absorbing fins and a plurality of first heat transfer tubes. The heat absorbing fins are arranged in parallel, and a gap is formed between adjacent heat absorbing fins to form an air channel for air circulation. One end of each of the first heat transfer tubes is arranged to pass through the heat absorbing fins, and the other end is connected with the heat transfer substrate.

Further, the heat dissipating component contains a plurality of heat dissipating fins and a plurality of second heat transfer tubes and a heat dissipating fan, wherein the heat dissipating fins are arranged in parallel, and a gap is formed between adjacent heat dissipating fins to form an air channel for air circulation. The heat dissipating fan is arranged at a tuyere position of the air channel. The extending directions of the air channel of the heat dissipating component are staggered with that of the air channel of the heat absorbing component to better dissipate heat generated by the light source component. In order to achieve waterproof performance of the light, the heat dissipating fan is configured to be waterproof. One end of each of the second heat transfer tubes is arranged to pass through the heat dissipating fins, and the other end is connected with the heat transfer substrate. Since the heat dissipating component is positioned outside the main housing and has a corresponding air channel for air circulation, the heat transferred from the light source component inside the main housing can directly exchange heat with the external space, which can achieve desired heat dissipation effect. In addition, the heat dissipating component is non-conductive, and the heat dissipating fan is waterproof, the entire heat dissipating component thus can be exposed to rain or water, which does not influence the using effect of the light.

Further, an outer periphery of the heat dissipating component is provided with a protective shell containing a heat dissipating port, and the heat dissipating port corresponds to the position of the heat dissipating fan. The arrangement of the protective housing can well protect the heat dissipating component, and the arrangement of the heat dissipating port which will not hamper heat dissipation of the heat dissipating component.

Further, an outer side of the main housing is provided with a plurality of sheet protrusions, distributed along a circumferential direction of the main housing, for effectively diffusing the heat to external air, which is conducted from the inside of the light to the main housing, thus accelerating the dissipating flow of the thermal airflow to achieve efficient heat dissipation. A maintenance port containing a maintenance cover is arranged on a rear side or a front side of the main housing. The maintenance port is configured to facilitate maintenance and cleaning of the light. The maintenance cover is fixedly connected with the main housing through a bolt, and a second waterproof seal ring is arranged between the maintenance cover and the main housing. A second annular groove surrounding the maintenance port is arranged on the main housing. One side of the second waterproof seal ring is embedded in the second annular groove, and the other side is in close contact with the maintenance cover. The second waterproof seal ring is arranged so that rainwater or the like can be prevented from entering the inside of the main housing from the junction of the maintenance cover and the main housing.

Further, a light exit is arranged at the front end of the main housing and the light exit contains a light-exiting lens. A third waterproof seal ring is arranged between the light-exiting lens and the main housing. The main housing is connected with a U-shaped support frame, and a fourth waterproof seal ring is arranged at the junction between the main housing and the U-shaped support frame. The arrangement of the third waterproof seal ring and the fourth waterproof seal ring can prevent rainwater or the like from entering the inside of the main housing from the corresponding junction.

Compared with the prior art, some beneficial effects can be obtained according to the present invention.

The heat transfer substrate of the present invention is attached to the main housing, so that the inside of the main housing forms an enclosed space for waterproof purpose. In addition, since the heat absorbing component and the heat dissipating component are respectively installed inside and outside the main housing, the heat generated by the light source component is absorbed by the heat absorbing component, and is transferred to the heat dissipating component through the first heat transfer tube and the heat transfer substrate, and then directly exchanges heat with the external air through the heat dissipating component, so that the stage light can well achieve effective heat dissipation effect as well as waterproof function. Therefore, the stage light according to the present invention can be widely used in various occasions such as indoors and outdoors, moreover the present invention has simple and compact structure, with high cost performance, and is convenient for popularization and application.

DESCRIPTION OF EMBODIMENTS

Figure 1:
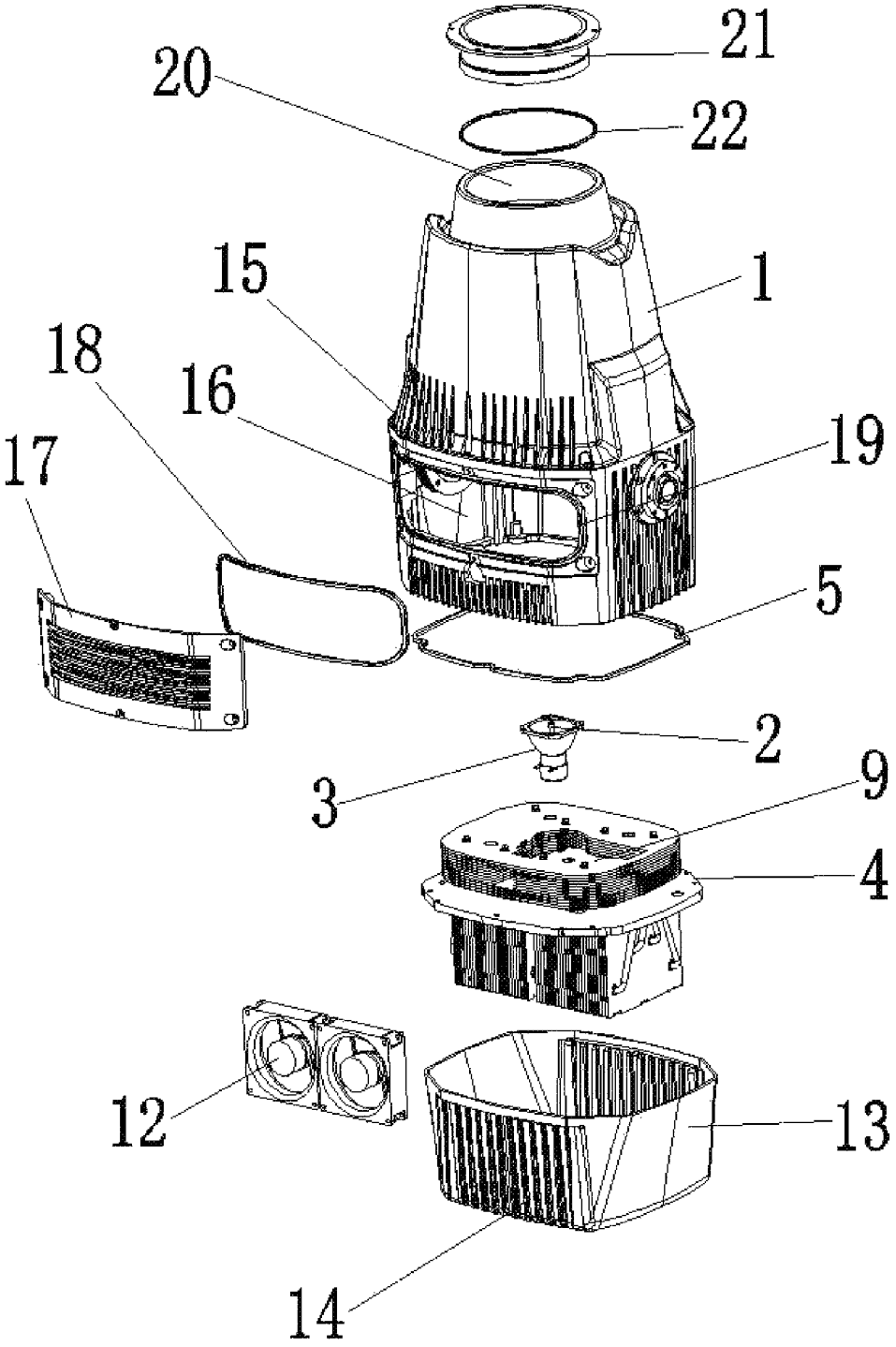
FIG. 1 is a schematic exploded view of an overall structure according to the present invention.

The attached drawings are for illustration only and are not intended to limit the present invention. Some components in the attached drawings are omitted, enlarged or reduced for better illustrating the embodiments, and sizes of these components do not represent sizes of actual product. For those skilled in the art, it will be understood that some known structures in the drawings and descriptions thereof are omitted. The positional relationships described in the drawings are for illustration only and are not intended to limit the present invention.

As shown in FIGS. 1 to 4, a waterproof stage light with efficient heat dissipation according to one preferable embodiment includes a light source component, a heat dissipating system and a main housing 1 which is waterproof, wherein an opening 101 is arranged at the rear end of the main housing 1, the heat dissipating system is in seal connection with the opening 101 such that the main housing 1 forms an enclosed space; one end of the heat dissipating system is positioned inside the main housing 1 and the other end thereof is positioned outside the main housing 1; and the light source component is positioned on the end of the heat dissipating system that is positioned inside the main housing 1. Such an arrangement causes that the heat generated by the light source component can be directly absorbed by the end of the heat dissipating system that is positioned inside the main housing 1, the heat dissipating system directly then transfers the absorbed heat to the other end through heat exchange and then discharges the exchanged heat to the outside of the light. Therefore, the heat generated by the light source during operation can be well discharged in time.

As shown in FIGS. 1 to 4, the heat dissipating system contains a heat absorbing component, a heat transfer substrate 4, and a heat dissipating component. The heat transfer substrate 4 covers the opening 101 at the rear end of the main housing 1 and is in seal connection with the main housing 1. The heat absorbing component and the heat dissipating component are respectively arranged on both sides of the heat transfer substrate 4. In addition, the heat absorbing component is located inside the main housing 1, and the heat dissipating component is located outside the main housing 1. Through such configuration, the heat absorbing component can absorb the heat generated by the light source component, then the absorbed heat can be exchanged to the heat dissipating component by the heat transfer substrate 4, and the heat dissipating component will dissipate the exchanged heat to the outside of the light.

Figure 2:
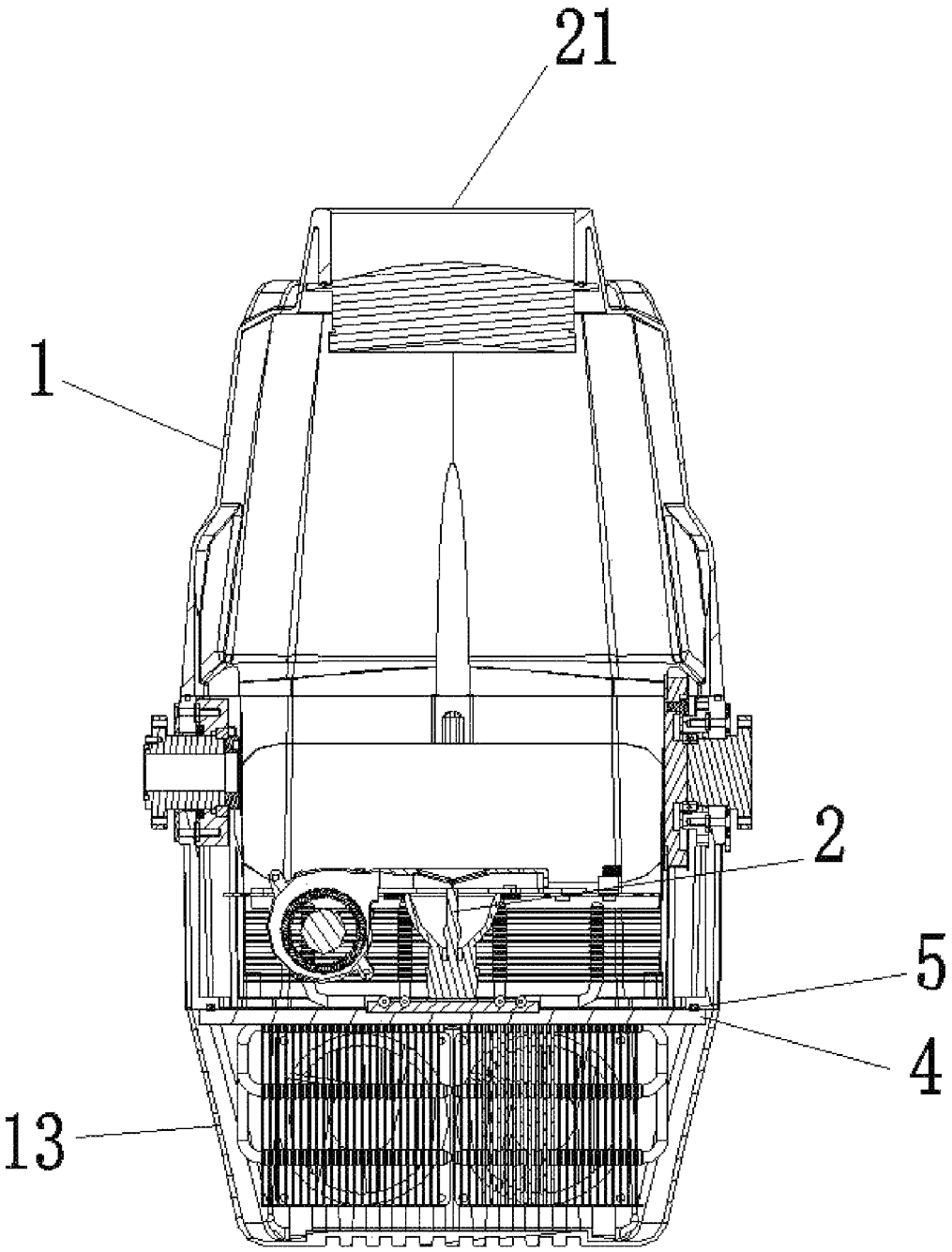
FIG. 2 is a schematic structural view of a longitudinal cross section of the present invention.
Figure 3:
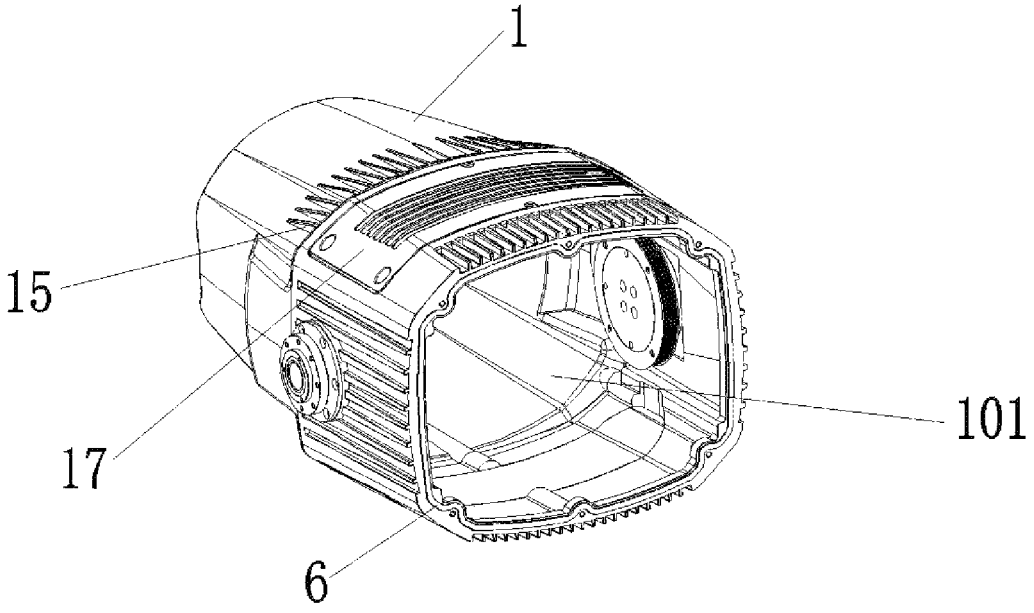
FIG. 3 is a schematic view showing the structure of the main housing of the present invention.

As shown in FIGS. 1 to 3, a first waterproof seal ring 5 is arranged between the heat transfer substrate 4 and the main housing 1. A first annular groove 6 surrounding the opening 101 is arranged on the rear end surface of the main housing 1. The heat transfer substrate 4 is fixed with the main housing 1 via a bolt. One side of the first waterproof seal ring 5 is embedded in the first annular groove 6, and the other side is in close contact with the heat transfer substrate 4. The arrangement of the first waterproof seal ring 5 can prevent rainwater or the like from entering the inside of the main housing 1 through the junction of the heat transfer substrate 4 and the main housing 1.

Figure 4:
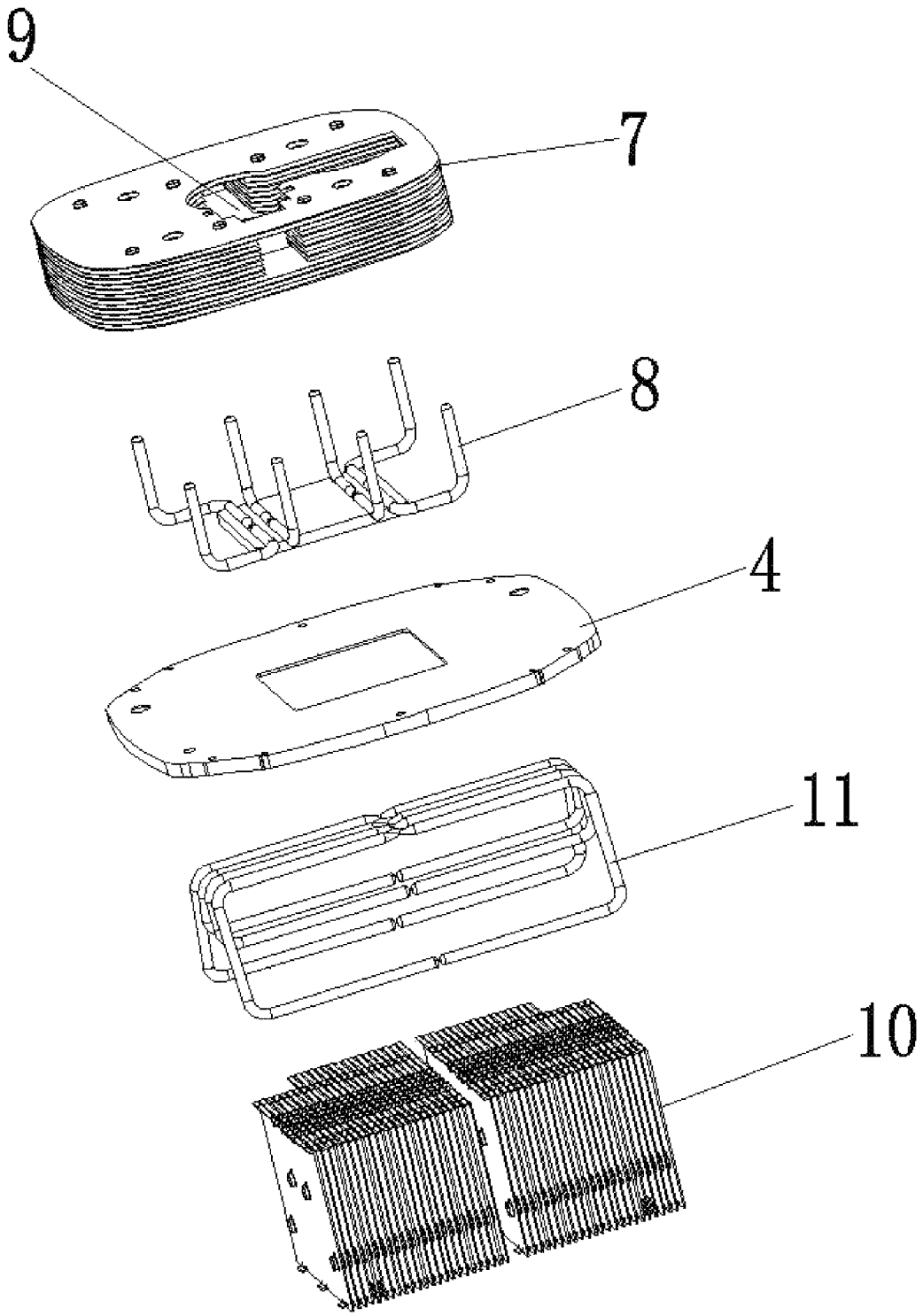
FIG. 4 is a schematic exploded view of an overall structure of a heat dissipating system according to the present invention.

As shown in FIGS. 1, 2 and 4, the heat absorbing component is provided with an installation position 9. The light source component, containing a light source 2 and a reflecting device 3 surrounding the light source 2, is installed in the installation position 9. In addition, the heat absorbing component surrounds the reflecting device 3 of the light source component and is attached to the reflecting device 3 of the light source component.

As shown in FIGS. 1 and 4, the heat absorbing component contains a plurality of heat absorbing fins 7 and a plurality of first heat transfer tubes 8. The heat absorbing fins 7 are arranged in parallel, and a gap is formed between adjacent heat absorbing fins 7 to form an air channel for air circulation. One end of each of the first heat transfer tubes 8 is arranged to pass through the heat absorbing fins 7, and the other end is connected with the heat transfer substrate 4.

As shown in FIGS. 1 and 4, the heat dissipating component contains a plurality of heat dissipating fins 10 and a plurality of second heat transfer tubes 11 and a heat dissipating fan 12, wherein the heat dissipating fins 10 are arranged in parallel, and a gap is formed between adjacent heat dissipating fins 10 to form an air channel for air circulation. The heat dissipating fan 12 is arranged at a tuyere position of the air channel. The extending directions of the air channel of the heat dissipating component are staggered with that of the air channel of the heat absorbing component to better dissipate heat generated by the light source component. In order to achieve waterproof performance of the light, the heat dissipating fan 12 is configured to be a waterproof fan. One end of each of the second heat transfer tubes 11 is arranged to pass through the heat dissipating fins 10, and the other end is connected with the heat transfer substrate 4. Since the heat dissipating component is positioned outside the main housing 1 and has a corresponding air channel for air circulation, the heat transferred from the light source component inside the main housing 1 can directly exchange heat with the external space, which can achieve desired heat dissipation effect. In addition, the heat dissipating component is non-conductive, and the heat dissipating fan 12 is waterproof, the entire heat dissipating component thus can be exposed to rain or water, which does not influence the using effect of the light.

As shown in FIGS. 1 and 2, the outer periphery of the heat dissipating component is provided with a protective housing 13 containing a heat dissipating port 14, and the heat dissipating port 14 corresponds to the position of the heat dissipating fan 12. The arrangement of the protective housing 13 can well protect the heat dissipating component, and the arrangement of the heat dissipating port 14 will not hamper heat dissipation of the heat dissipating component.

As shown in FIGS. 1 and 3, the outer side of the main housing 1 is provided with a plurality of sheet protrusions 15, distributed along the circumferential direction of the main housing 1, for effectively diffusing the heat to external air, which is conducted from the inside of the light to the main housing 1, thus accelerating the dissipating flow of the thermal airflow to achieve efficient heat dissipation. A maintenance port 16 containing a maintenance cover 17 is arranged on the rear side or a front side of the main housing 1. The maintenance port 16 is configured to facilitate maintenance and cleaning of the light. The maintenance cover 17 is fixedly connected with the main housing 1 through a bolt, and a second waterproof seal ring 18 is arranged between the maintenance cover 17 and the main housing 1. A second annular groove 19 surrounding the maintenance port 16 is arranged on the main housing 1. One side of the second waterproof seal ring 18 is embedded in the second annular groove 19, and the other side is in close contact with the maintenance cover 17. The second waterproof seal ring 18 is arranged so that rain water or the like can be prevented from entering the inside of the main housing 1 from the junction of the maintenance cover 17 and the main housing 1.

As shown in FIGS. 1 and 2, the front end of the main housing 1 is provided with a light exit 20, and the light exit 20 contains a light-exiting lens 21. A third waterproof seal ring 22 is arranged between the light-exiting lens 21 and the main housing 1. The main housing 1 is connected with a U-shaped support frame, and a fourth waterproof seal ring is arranged at the junction between the main housing 1 and the U-shaped support frame. The arrangement of the third waterproof seal ring 22 and the fourth waterproof seal ring can prevent rainwater or the like from entering the inside of the main housing 1 from the corresponding junction.

Obviously, the above embodiment of the present invention is merely examples for clear illustration of the present invention, and is not intended to limit the implementation of the present invention. Modifications or changes can be made by those skilled in the art on the basis of the above description. There is neither need nor exhaustion for all implementations. Any modification, equivalent substitution, improvement, or the like within the spirit and principle of the present invention should be included in the scope of the claims of the present invention.

The invention claimed is:

1. A waterproof stage light with efficient heat dissipation, comprising:

a light source component;

a heat dissipating system;

and a waterproof main housing, at the rear end of which an opening is arranged, wherein the heat dissipating system is in seal connection with the opening, one end of the heat dissipating system is positioned inside the main housing and the other end thereof is positioned outside the main housing, and the light source component is positioned on the end of the heat dissipating system that is positioned inside the main housing, and wherein the heat dissipating system contains a heat absorbing component;

a heat transfer substrate covering the opening at the rear end of the main housing and in seal connection with the main housing; and a heat dissipating component;

wherein the heat absorbing component and the heat dissipating component are respectively provided on both sides of the heat transfer substrate, and the heat absorbing component is located inside the main housing and the heat dissipating component is located outside the main housing.

2. The waterproof stage light according to claim 1, wherein a first waterproof seal ring is arranged between the heat transfer substrate and the main housing;

a first annular groove surrounding the opening is arranged on the rear end surface of the main housing;

the heat transfer substrate is fixed with the main housing via a bolt; and one side of the first waterproof seal ring is embedded in the first annular groove, and the other side thereof is in close contact with the heat transfer substrate.

3. The waterproof stage light according to claim 1, wherein the heat absorbing component is provided with an installation position; and the light source component containing a light source and a reflecting device surrounding the light source is arranged in the installation position.

4. The waterproof stage light according to claim 1, wherein the heat absorbing component contains a plurality of heat absorbing fins which are arranged in parallel, wherein a gap is formed between adjacent heat absorbing fins to form an air channel for air circulation; and a plurality of first heat transfer tubes, wherein one end of each of the first heat transfer tubes is arranged to pass through the heat absorbing fins, and the other end thereof is connected with the heat transfer substrate.

5. The waterproof stage light according to claim 1, wherein the heat dissipating component contains a plurality of heat dissipating fins which are arranged in parallel, wherein a gap is formed between adjacent heat dissipating fins to form an air channel for air circulation;

a plurality of second heat transfer tubes, wherein one end of each of the second heat transfer tubes is arranged to pass through the heat dissipating fins, and the other end thereof is connected with the heat transfer substrate; and a heat dissipating fan arranged at a tuyere position of the air channel.

6. The waterproof stage light according to claim 5, wherein the outer periphery of the heat dissipating component is provided with a protective housing containing a heat dissipating port which corresponds to the position of the heat dissipating fan.

7. The waterproof stage light according to claim 1, wherein the outer side of the main housing is provided with a plurality of sheet protrusions distributed along a circumferential direction of the main housing.

8. The waterproof stage light according to claim 1, wherein a maintenance port containing a maintenance cover fixedly connected to the main housing via a bolt is arranged on the rear side or a front side of the main housing; and a second waterproof seal ring is arranged between the maintenance cover and the main housing.

9. The waterproof stage light according to claim 8claim 8, wherein a second annular groove surrounding the maintenance port is arranged on the main housing; and one side of the second waterproof seal ring is embedded in the second annular groove, and the other side thereof is in close contact with the maintenance cover.

10. The waterproof stage light according to claim 1, wherein the front end of the main housing is provided with a light exit containing a light-exiting lens;

a third waterproof seal ring is arranged between the light-exiting lens and the main housing;

the main housing 1 is connected with a U-shaped support frame; and a fourth waterproof seal ring is arranged at the junction between the main housing and the U-shaped support frame.

* * * * *